US009311793B2

(12) United States Patent
Lohbihler

(10) Patent No.: US 9,311,793 B2
(45) Date of Patent: Apr. 12, 2016

(54) MOTION AND AREA MONITORING SYSTEM AND METHOD

(71) Applicant: Andrew Lohbihler, Waterloo (CA)

(72) Inventor: Andrew Lohbihler, Waterloo (CA)

( * ) Notice: Subject to any disclaimer, the term of this patent is extended or adjusted under 35 U.S.C. 154(b) by 614 days.

(21) Appl. No.: 13/659,537

(22) Filed: Oct. 24, 2012

(65) Prior Publication Data

US 2013/0099922 A1 Apr. 25, 2013

Related U.S. Application Data

(60) Provisional application No. 61/550,713, filed on Oct. 24, 2011.

(51) Int. Cl.

| | |
|---|---|
| ***G08B 1/08*** | (2006.01) |
| ***G08B 13/184*** | (2006.01) |
| *G08B 13/24* | (2006.01) |
| *G08B 29/26* | (2006.01) |

(52) U.S. Cl.

CPC ..... *G08B 13/184* (2013.01); *G08B 13/2491* (2013.01); *G08B 29/26* (2013.01)

(58) Field of Classification Search

None

See application file for complete search history.

(56) References Cited

U.S. PATENT DOCUMENTS

| | | | | |
|---|---|---|---|---|
| 4,041,285 | A | 8/1977 | Shidel | |
| 5,170,162 | A | 12/1992 | Fredericks | |
| 5,291,020 | A | 3/1994 | Lee | |
| 5,870,022 | A | 2/1999 | Kuhny | |
| 6,177,903 | B1 * | 1/2001 | Fullerton et al. | 342/28 |
| 6,348,863 | B1 | 2/2002 | Krubiner | |
| 6,707,486 | B1 | 3/2004 | Millet | |
| 2010/0238030 | A1 | 9/2010 | Shafer et al. | |
| 2011/0181412 | A1 * | 7/2011 | Alexander et al. | 340/541 |
| 2011/0279366 | A1 | 11/2011 | Lohbihler | |

FOREIGN PATENT DOCUMENTS

WO W02010085877 A1 8/2010

* cited by examiner

*Primary Examiner* — Ojiako Nwugo

(74) *Attorney, Agent, or Firm* — Daniel Boudwin; Global Intellectual Property Agency, LLC.

(57) ABSTRACT

Disclosed is a motion detection system for use in entryways or areas wherein a user may wish to monitor activity, comprising a wireless emitter and detector or system thereof. The emitters utilize a plurality of infrared or other media sensors to emit outgoing signals detecting an object blocking a pathway prescribed by an area between the emitter and a predetermined barrier. Reflections of the outgoing signals are received by the detector and an internal processor calculates an action based on the received input. An automatic calibration is conducted to match the physical reflectivity of the area to minimize false alarms, while the direction of a passing object is determined by a calculated reflection strength gradient and/or time-delay in signal reflectivity. The emitters may be programmed to emit certain alerts based on their input or send signals to a base station, which is communicated to via wireless transmission.

22 Claims, 10 Drawing Sheets

Lateral Motion Detection Algorithm and Process

MOTION AND AREA MONITORING SYSTEM AND METHOD

CROSS REFERENCE TO RELATED APPLICATION

This application claims the benefit of U.S. Provisional Application No. 61/550,713 filed on Oct. 24, 2011, entitled "Directional Entry Detection and Alarm Reporting Device." The above identified patent application is herein incorporated by reference in its entirety to provide continuity of disclosure.

BACKGROUND OF THE INVENTION

1. Field of the Invention

The present invention relates to motion detectors, monitoring systems and security systems. More specifically, the present invention pertains to a wireless transceiver that once positioned, can automatically calculate and determine the existing structure of the area and monitor for incoming or outgoing objects. The direction of the objects is determined to provide a means of monitoring, deterring or notifying of an intrusion into the monitored space, as programmed. The device applies to a variety of locations and for various purposes, such as pest deterrence, home security, area monitoring or other similar situations where human vigilance may be impossible but knowledge of object presence or deterrence is desired.

The present invention provides a means to monitor a given area and significantly reduce false alarms, which are common for standard motion detection systems and alarm systems of this type. An opposing barrier or surface is calibrated when the emitter/receiver (transceiver) is initialized, which allows a processor to determine a baseline state and establish the natural boundaries of its detection zone and realize what reflections will always be present during operation. A plurality of sensors emits a signal from a transceiver, where the signal reflects from objects within the field of view of the emitter. The reflections of the emitted signal are monitored by a receiver. Deviations in the baseline state (i.e. natural boundaries) are calculated to determine if a violation has occurred over an environmental disturbance. Action may be taken if a violation has indeed occurred, which may include activation of different alerts or alarm means, or further processing of the deviations for specific actions based on the situation and scenario for which the present invention is deployed. Several embodiments and uses of the present device and detection method are herein disclosed.

Processing software within the device determines a suitable alarm for a given scenario. This may include an audible alarm for indicating human entry, an inaudible but ultrasonic alarm for a pet or pest control, or a wireless alert to covertly indicate an intrusion, wherein an audible alert may not otherwise be desired. Use of the present invention for tracking game balls is also contemplated, where a game ball can be tracked within a given zone for golf or baseball game activity. Direction processing of the object within the field of view of the transceiver allows strategies to be programmed into the device, such as activating the alarm to alert upon entry into, but not on exit from a given threshold. The use of several transmitters allows for the object direction of motion or direction vector to be determined, while the algorithms within the processor monitor and initiate appropriate actions if a violation is encountered, based on programmed action conditions. The transceivers are provided using wireless technology, which allows for remote device programming from and communication to a common base station. Alerts may form as signals that are wirelessly transmitted to the base station, reducing wiring difficulties, while the wireless construction of the transceiver facilitates rapid or covert installation if so desired. Wireless messaging alerts from multiple devices is possible, where a common base station continually monitors a plurality of different transceivers in a given area.

2. Description of the Prior Art

In the past, Infrared (IR) detection devices were not directional, as they often relied on an emitter placed opposite of a receiver device. Detection occurred by blocking the beam completely and initiating an alarm. More modern methods of IR sensor devices use an emitter and receiver but offer no approach to determine the level of signal reflectivity as a function of distance. Often these devices can only accommodate a fixed door width and do not automatically adjust for the variable width of any door or opening that is required to be guarded.

Pet training devices are not based on IR beam detection or blockage, but commonly rely on Passive Infrared (PIR) devices that detect proximity within a room area. PIR devices can detect the presence of a pet inside a room but only as motion detection, with the direction of movement across an entryway area being unknown. Keeping pets out of specific room having a single or multiple entryways is not generally possible unless a directional device is used. It is desired that the present invention includes the ability to program for situations where a pet is to be penalized for entering the room or area but not penalized for exiting the same area. Knowledge of the object and the ability to detect the object direction of motion are required for enabling this feature.

Conventional devices utilizing ultrasound for remote sensing, such as ultrasonic burglar alarms, have been severely limited by the directionality of ultrasonic beams, acoustical shadowing and limited range inherently characteristic of ultrasonic devices. For this reason they have been largely replaced by radio frequency and infrared transceivers. Although ultrasonic beams can be placed across a door frame, the scattering of a beam is unpredictable at short range and may lead to many false alarms. Ultrasonic emitters and receivers are also generally more expensive than IR emitters and receivers.

In the pet field, electronic containment systems and remote trainers use radio frequency based transmitters and receivers. These devices are expensive to produce and are severely restricted by the fact that they create interference with other radio frequency transmissions. To avoid this problem, manufacturers must use extremely low powered devices, practical for only very short-range operation, or subject the design to restrictions placed upon it by regulating agencies such as the Federal Communications Commission (FCC). The use of ultrasound has been largely ignored as an alternative for the reasons listed above.

IR detection devices are typically not used because of their interference with televisions and remote control devices that commonly employ IR for active switching. More commonly, IR receivers are now available that operate at frequencies that do not interfere with common remote switching devices. For example, remote controls operate at an IR carrier frequency of 38 to 56 KHz, and more IR receiving devices are available at 25 KHz or over 100 KHz to 4 MHz (such as IrDA) to minimize interference with television remote signals. IR receivers also have built-in automatic gain control features that allow them to be reliable even in darkness and direct sunlight, and further from large interference sources such as incandescent, fluorescent and CFL lights.

Remote pet trainers typically use a hand held radio frequency transmitter to activate a single output (usually an electric shock or an irritating sound pulse) at the receiver worn by the pet. The single output of conventional systems is used as a negative reinforcing stimulus rather than a positive enforcement of a specific behavior. If pets are to be shock-trained using shock collars, or sonically trained using ultrasonic sound bursts, then wireless devices using directional detection devices can shock them if they enter a room only, and allow the pet to safely leave the room without receiving a second correction burst, which would be counterproductive. The ability to determine direction as well as actual presence of an object allows the pet to be corrected when entering but not if they are leaving the room.

Another method of pet detection that is commonly deployed is based on an active or passive RFID installed on a pet collar. Reader systems for these devices are not inexpensive, nor do they have long ranges for a door opening, and further are not easily mounted onto a door frame. As such RFID's are another source of technology that cannot be used to determine direction of motion of an object as provided by the present invention. These RFID systems can further not be used for passive detection without an actual RFID on the object in motion, limiting their use.

Devices have been disclosed in the prior art that relate to object detection systems and alarm systems. These include devices that have been patented and published in patent application publications, and generally relate to wired systems that fail to calculate both the presence and vector of the object being detected. A review of the patents in the prior art reveal no similar device, structure or method of monitoring that describes features of the present invention. The prior art fail to address several key improvements disclosed by the present invention and incorporate inherent drawbacks that limit their usefulness or novelty. Specifically, the ability to monitor motion using a plurality of sensors, the ability to calibrate to a given area and calculate alertable events, and finally the combination of these aspects with the structure of the device and its wireless operation are unique aspects in the field that are not previously disclosed. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 5,170,162 to Fredericks describes a device that monitors direction of motion of objects to determine, in a manner in which substantially avoids false alarms, whether there is object motion in a direction of interest. The device may be employed as a warning signal in response to a vehicular traffic conditions of interest and include at least a pair of motion detectors. Each motion detector processes motion bearing signals to determine distance traveled in a predetermined time period to minimize false alarms. The Fredericks device is suitable for determining if a vehicle is traveling along a road in the incorrect direction, prompting a signal to drivers and authorities of the hazard. The present invention pertains to a small unit or system of units that comprise transceivers that measure the environment and react based on programmed logic for the given condition, where entry detection and vector calculations are conducted for various ends.

U.S. Pat. No. 6,707,486 to Millet describes an alarm system that automatically monitors activity and directional motion in a predetermined area. When the system detects a particular movement in an area, an alarm is triggered which ultimately notifies a system operator or allows the system to initiate some other automated activity. The system detects movement by comparing changes in the center of mass of objects captured in sequential video image frames. In addition, filters may be added to decrease the number of false alarms. Specifically, the alarms may only be generated if the system detects movement in a particular direction. The Millet device pertains to a video monitoring system and software therefor, where the center of mass of an object is calculated and tracked for alarm triggering.

U.S. Published Patent Application, Publication No. 2010/0238030 to Shafer discloses a detector system including a detector and method for sensing motion within a detection region. The detector has a detection element and a focusing element aiming received energy corresponding to a presence within the detection region toward the detection element. The focusing element has a plurality of sections in which each of the plurality of sections establishes a corresponding detection zone within the detection region. The plurality of sections are arranged to allow a motion vector to be determined for an object passing through the detection region. The Shafer disclosure utilizes zones of detection to determine object movement, while the present invention utilizes a pair of transceivers or a system thereof to determine the presence and direction of an object entering the transceiver's field of view.

U.S. Pat. No. 6,348,863 to Krubiner discloses a method and apparatus for detecting intrusions, such as intrusions through a door or window of a room, in a manner which ignores movements in other adjacent regions. The method includes exposing the monitored space to a passive infrared sensor having a first sensor element generating a positive polarity signal when its field of view senses an infrared-radiating moving object, and a second sensor element generating a negative polarity signal when its field of view senses an infrared-radiating moving object. A movement signal is generated when both signals have been generated within a first time interval such as to indicate the movement of an object within the monitored space. The relative sequential order of the movement signal the direction of movement of the detected object is determined to realize a hostile or friendly direction, whereby an alarm is actuated when the direction of the movement signal is determined to be hostile.

U.S. Pat. No. 5,291,020 to Lee discloses a dual pyroelectric-effect sensor having the sensing elements aligned in a motion plane permits direction determinations to be made for moving IR sources. Dual sensing-element PIR sensors provide different voltage outputs depending upon a relative direction of movement of an object and the sensing elements. By alternating the effective polarizations of the sensing elements in the PIR sensor, clear direction information is available from the PIR sensor. A direction detecting circuit working in cooperation with a switch controller employing a counter and a timer, permits independent tallying of entrances and exits. Upon the counter indicating that the number of objects that exited the area equals the number of objects that entered, the lights are immediately extinguished. The timer ensures that the lights turn off should incorrect values become recorded in the counter. The Lee device is based on a timer and counter to determine when to activate and deactivate light sources within a room.

U.S. Pat. No. 5,870,022 to Kuhnly discloses a detection system and method capable of reducing the occurrence of false alarms and detection failures by compensating for variations in the amplitude of a detection signal generated by a PIR sensor. An adaptive threshold can be used that varies according to ambient temperature of the detection area and the frequency of the detection signal. Comparison of the detection signal to the adaptive threshold allows compensation for temperature- and/or frequency-induced variations in detection signal amplitude. The adaptive threshold can be configured for standard detection area conditions or calibrated for conditions at the installation site. Relative measurement and adaptive sampling techniques also can be used to compensate for the presence of low frequency shifts in the detection signal.

U.S. Pat. No. 4,041,285 discloses an electrical bi-directional motion sensing and clocking system is disclosed for identifying the relative sense and magnitude of movement experienced by a moving body. The corresponding relative motion of a target past a pair of sensor units produces a pair of input signal pulses from the sensors for each increment of movement experienced by the moving body. Each occurrence of such a pair of input pulses is recorded and gives rise to a clock output signal upon the recorded occurrence of both input signals. The relative occurrence sequence of the two input signals is also recorded and utilized to provide a respectively corresponding output representing the direction of body movement to be associated with the detected movement increment.

The present invention provides an entryway motion detection system that can determine the presence and direction of an object within the field of view of a transceiver. The device operates wirelessly to allow deployment without expensive installation costs, and the device can be programmed to operate in a number of different environments for tracking the direction of an object. It is submitted that the present invention substantially diverges in elements from the prior art, and consequently it is clear that there is a need in the art for an improvement to existing motion and area monitoring devices. In this regard the instant invention substantially fulfills these needs.

SUMMARY OF THE INVENTION

In view of the foregoing disadvantages inherent in the known types of motion and area monitoring devices now present in the prior art, the present invention provides a new system that can be utilized for providing convenience for the user when tracking motion and direction within a given area and for processing this information.

It is therefore an object of the present invention to provide a new and improved motion and area monitoring device that has all of the advantages of the prior art and none of the disadvantages.

It is another object is to provide a motion and area monitoring device that can be wirelessly situated for monitoring a given area for disturbances and provide desired alerts and/or alarms as a result of the occurrence.

Another object of the present invention to provide a dual-coded infrared sensor device that provides differential motion detection.

Another object of the present invention is to provide transceiver with a small, compact internal circuitry using readily available electrical components, with built-in wireless capability and an alerting and sensing means.

Another object of the present invention is to provide a base monitoring system to monitor a plurality of transceivers and take appropriate actions based on input therefrom.

Yet another object of the present invention is to provide a transceiver that can automatically calibrate to a given barrier when initially setup.

A final object of the present invention is to provide a plurality of alerting means that is effective at providing audible transmission to specific targets, including human audible ranges and pet/pest audible ranges.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

Figure 7A:
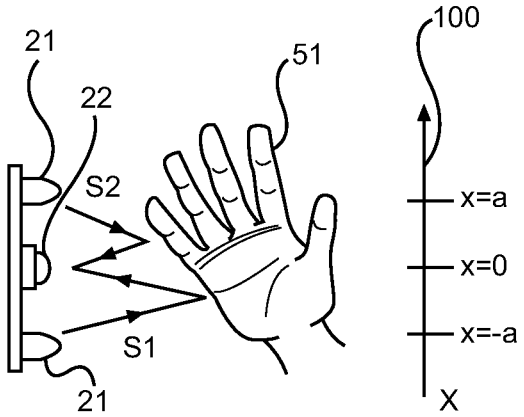

FIG. 7*a* shows a representation for determining lateral movement of an object with respect to the emitters.

Figure 7B:
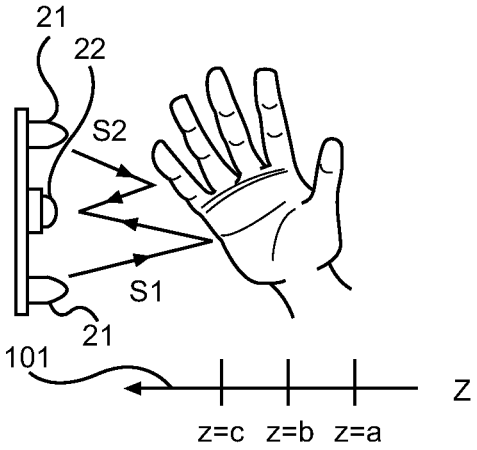

FIG. 7*b* shows a representation for determining axial movement of an object towards the emitters.

Figure 8A:
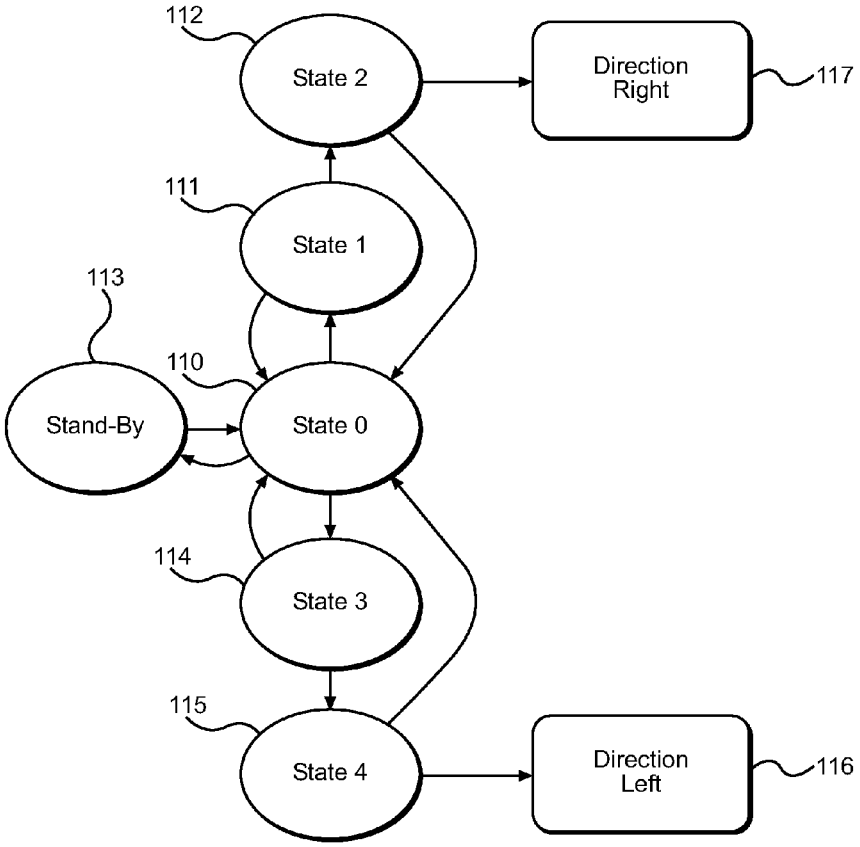

FIG. 8*a* shows a state transition diagram for determining a lateral movement event.

Figure 8B:
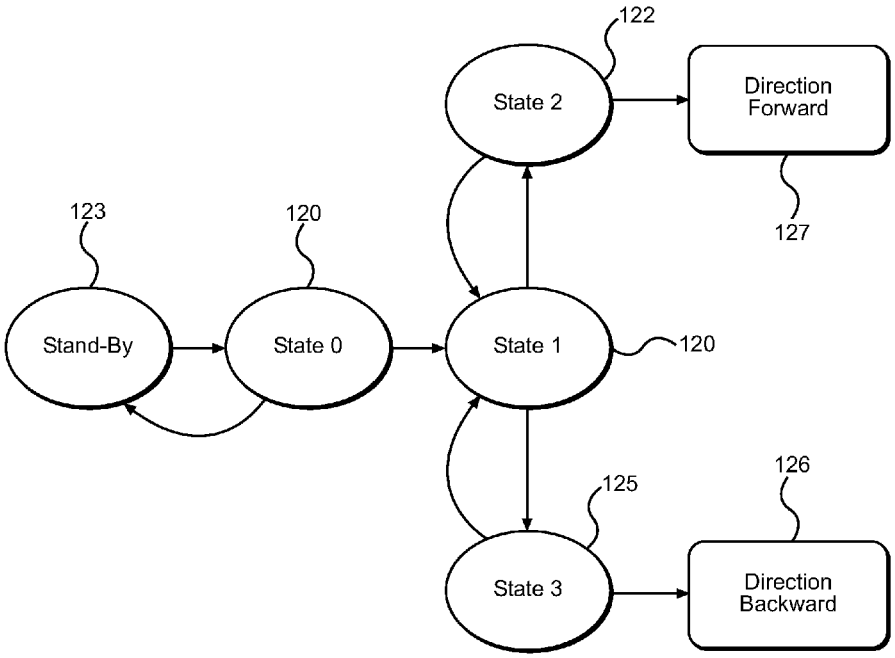

FIG. 8*b* shows a state transition diagram for determining an axial movement event.

DETAILED DESCRIPTION OF THE INVENTION

Reference is made herein to the attached drawings. Like reference numerals are used throughout the drawings to depict like or similar elements of the motion and area monitoring system. For the purposes of presenting a brief and clear description of the present invention, the preferred embodiment will be discussed as used for wirelessly tracking movement and communicating events to a common base station for processing. The figures are intended for representative purposes only and should not be considered to be limiting in any respect.

The present invention pertains to a method and system to determine if an object has enters through an area, determine the corresponding direction of movement of that object and then produce an alert or signal for further processing. The system of the method utilizes a transceiver assembly having least a first and second emitters and at least one signal receiver. No medium restriction is placed on the emitter type, including infrared (far and near), visible light, acoustic, radio, laser, combinations thereof or the like. It is not desired to limit the emitters to a specific type, but rather it is desired to disclose a system that utilizes a first and second emitter, a receiver and a means of processing the reflected signals from the emitters to determine an object presence within a given area and the direction of motion thereof. The outgoing emitted signals are reflected from an object and are received by the receiver to compare the reflection signal strength from two distinct emitters, calculating a gradient and a time-delay between the reflections of the first and second emitter. A threshold of detection is set to determine a minimum reflection for perceiving a valid detection over and above reflections of an elemental nature (i.e. interference, sunlight, background signal noise, etc.).

Figure 1:
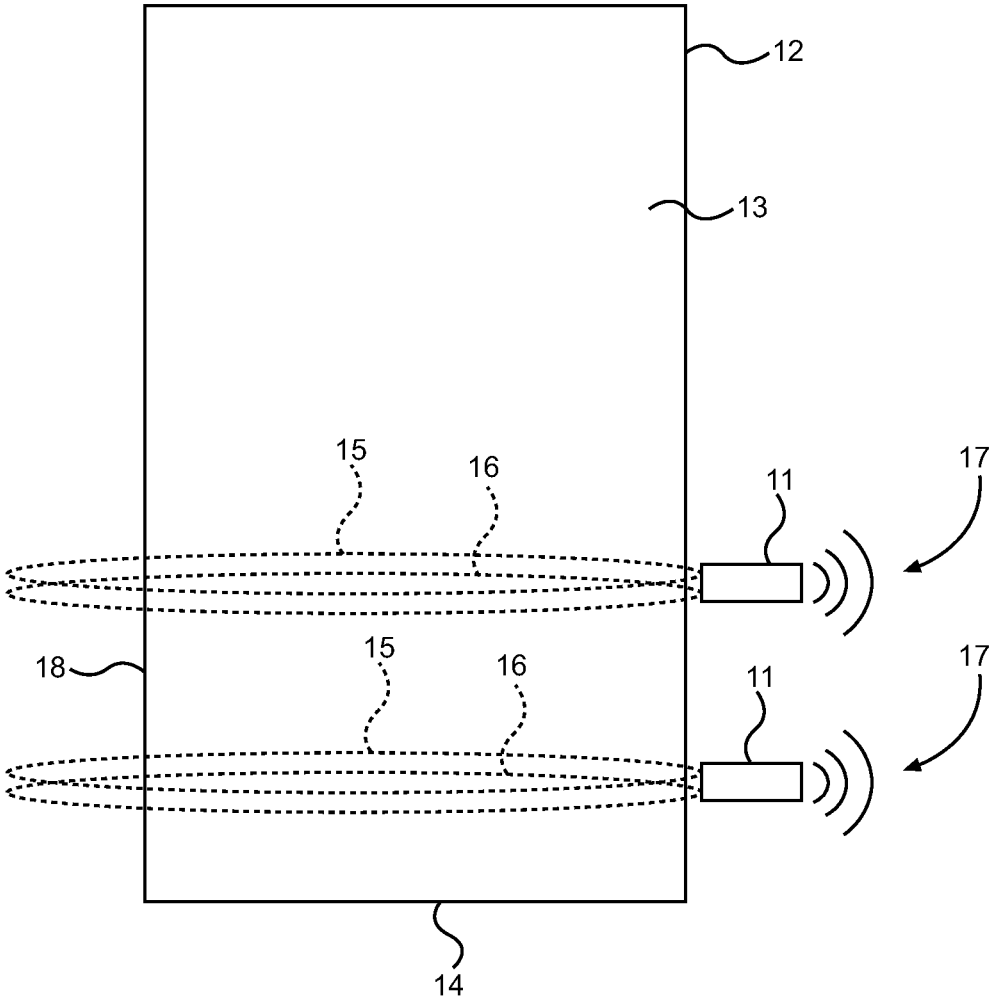
FIG. 1 shows the present invention utilized in an entryway with an upper and lower-mounted transceiver for monitoring different threat types.

Referring now to FIG. 1, there is shown a view of a first and second transceiver assembly 11 mounted along a wall 12 adjacent to an entryway area 13 and above the ground 14. Opposite of the transceivers 11 is an opposing wall 18 or opposing door frame. Each transceiver emits a first 16 and second 15 beam across the open area 13, which is reflected back to the transceiver 11 for processing. During installation, the assemblies 11 are initialized to train the assembly 11 to the existing environment. During this initialization state, the reflected signals are taken to be the natural boundaries of the area, such as an opposing wall 18 or door frame, whereafter this establishes a baseline from which changes in reflection signals therefrom and above a given threshold constitute a detected object. The calibration step prevents false-alarm detections and sets the baseline for each transceiver assembly 11 based on its unique location and the unique boundaries of the local environment. In this way, the assemblies 11 can be mounted anywhere and learn the surrounding area during setup. Typically this detection and calibration is performed through a series of operations by the embedded processor within each assembly.

Shown in FIG. 1 is a common setup for the present transceiver assemblies, where a first and second assembly 11 is mounted in a stacked configuration. This allows objects of varying heights to be monitored. Upon detecting an incursion by an object, the transceivers can be programmed to operate using a number of different logical commands, including emitting a signal 17 from the transceiver assembly. The simplest of these signals 17 is the use of an audible or supersonic signal from the local transceiver 11 itself. Another option is that a wireless signal is sent to a base receiving station for further processing. The incursion can be catalogued or categorized, where further action can be taken thereafter, including a return signal to the transceiver 11 for initiating an alert, an outgoing signal to a user monitoring the premises, storing the intrusion for later data analysis, or other outgoing alert signal for third party action. In FIG. 1, a first and second transceiver 11 are positioned to capture low-level movement and mid-height movement, whereby signals produced by the lower transceiver and not the higher transceiver can be processed as an intrusion by a pet or animal, or vise versa. Signals 17 are sent to the base station for processing of the two transceivers 11 and commands are returned for further action as previously described. This scenario is but one of many contemplated situations in which the present system and method can be deployed.

Figure 2:
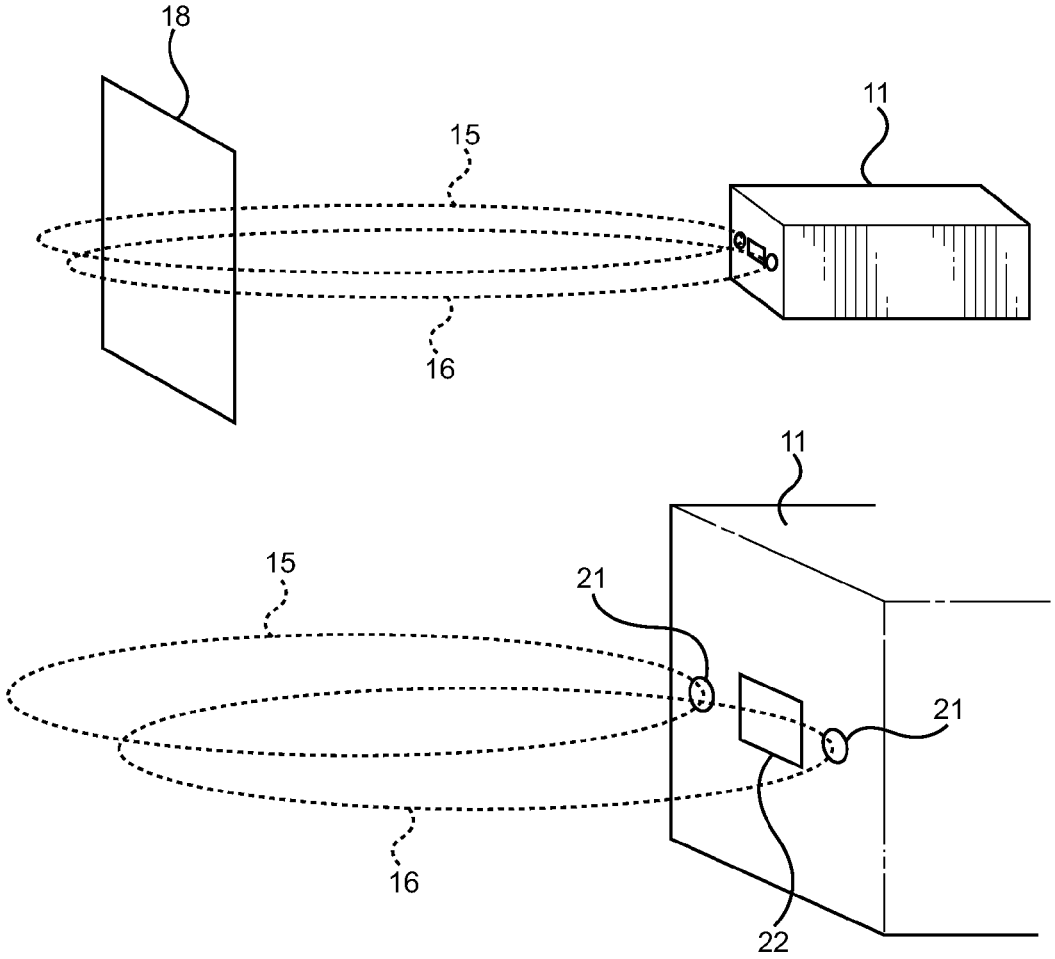
FIG. 2 shows the present invention transceiver emitting outgoing signals and calibrating to an existing wall surface.
Figure 3:
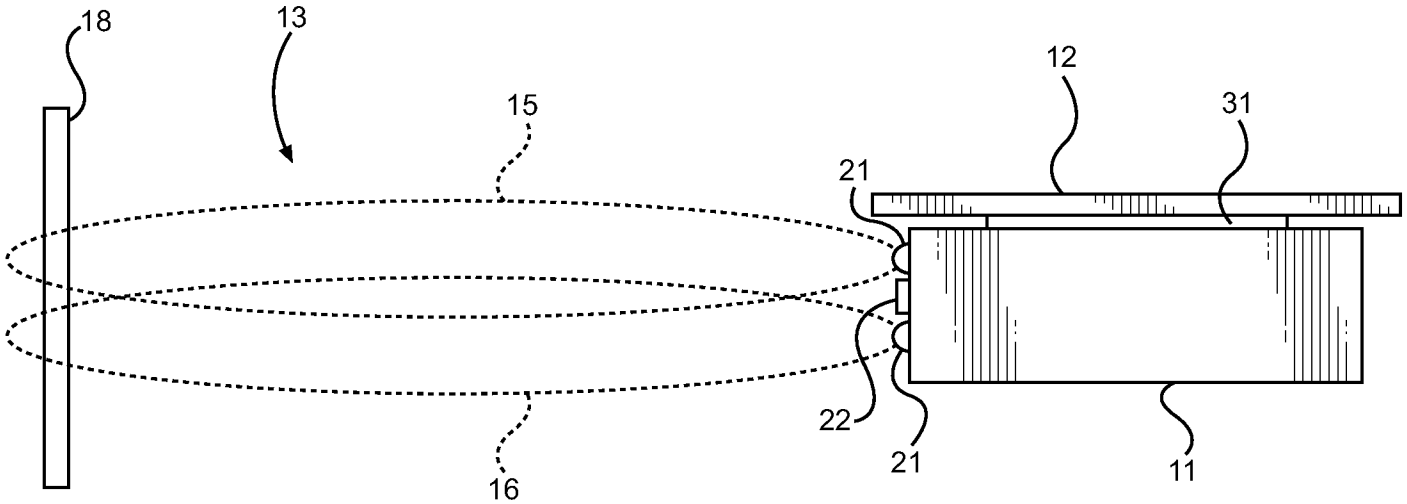
FIG. 3 shows an overhead view of the present invention transceiver emitting outgoing signals.

Referring now to FIGS. 2 and 3, there are shown views of the present system transceiver assembly 11 during operation. The transceivers comprise a first and second signal emitter 21 facing the same general direction, a signal receiver 22, a microprocessor, a memory, a network connection means, a power source and an ambient environment sensor. The emitters project a signal 15, 16 into an adjacent area, wherefrom the signals reflect from objects in the projected area 13. The reflected signals are measured by the receiver 22 for processing of the time delay and signal strength of the reflection to determine first: the surrounding environment, and second: if the environment has changed since the last signal transmission. The return strength and delay in detection are both used to determine distance of the object and its direction of travel within the given area, as calculated by an onboard processor or as calculated by a base station receiving signals from the transceiver assembly 11. During initialization, as previously discussed, the boundaries 18 of the environment are mapped to determine a zero state for the reflected signals, where deviations therefrom constitute detection of an object intrusion. Each transceiver assembly 11 can be positioned and secured 31 within an existing environment without hardwiring the assembly 11, reducing installation costs and the need to route wiring throughout a building or residence.

The initialization of the device begins with a calibration step to determine if a projection area has a defined near or far boundary that can reflect signals and trigger a false alarm. A typical entryway area or internal area can range from under 1 meter to several meters, depending on the type of area where the system is deployed. As such, the signal reflections can vary in strength according to the boundaries of the area. Calibration is required to determine if the environment has interference or existing signals that may trigger false alarms. The calibration process includes an ambient-light sensor to further and more distinctly determine if receiver is reading "noise" due to the environment or from some other effect. When calibration occurs, the device sends out signals and receives the reflected signals to determine the pre-existing reflections that will always be present, and if there is a known gradient in the response signals. A signal-to-noise boundary is established to significantly reduce the incidence of false alarms, and the boundary of the area is mapped to determine the baseline signal reflection response expected from each emitted signal pulse. This step is preferably performed as an auto-calibration step or procedure after placement of the transceiver assembly and randomly during operation, such that it is not known when the device calibrates or recalibrates, so as to not allow sophisticated tampering methods to "spoof" the device.

Each of the independent transceivers 11 is powered by a wired AC power source or stand-alone, onboard battery power. A low-power mode of operation (referred to as standby mode) allows each device 11 to operate at a reduced electrical power draw, preserving the life of the battery. The device will enter low-power mode when there is no significant activity of detection, usually after a set time period that can be programmed by the user. This time is generally when the user is not concerned about intrusion and is not in need of an alert signal. The device continues sustained entry detection performance, but produces significantly fewer entry detection cycles or pulses of emitter signals (for example, cycling the emitter 0.5 to 1.0 Hz), which also permits the system to be less sensitive to noise fluctuations. The device will exit from low-power mode when a significant change in the noise measurement is recorded, typically indicating motion in the surrounding of the entry area. An ambient light sensor (or other ambient sensor) is utilized in conjunction with the emitters during low-power operation to aide in determining if there are changes in the surrounding area requiring heightened scrutiny and observation using a higher frequency of emitter signal output. Ambient environment sensors include scenarios of detecting light switch events by monitoring ambient light, noise sensing, or any other suitable ambient sensor that can be used in conjunction with the emitters to measure far field changes that are used to activate or deactivate standby-mode emitter operation.

Figure 4:
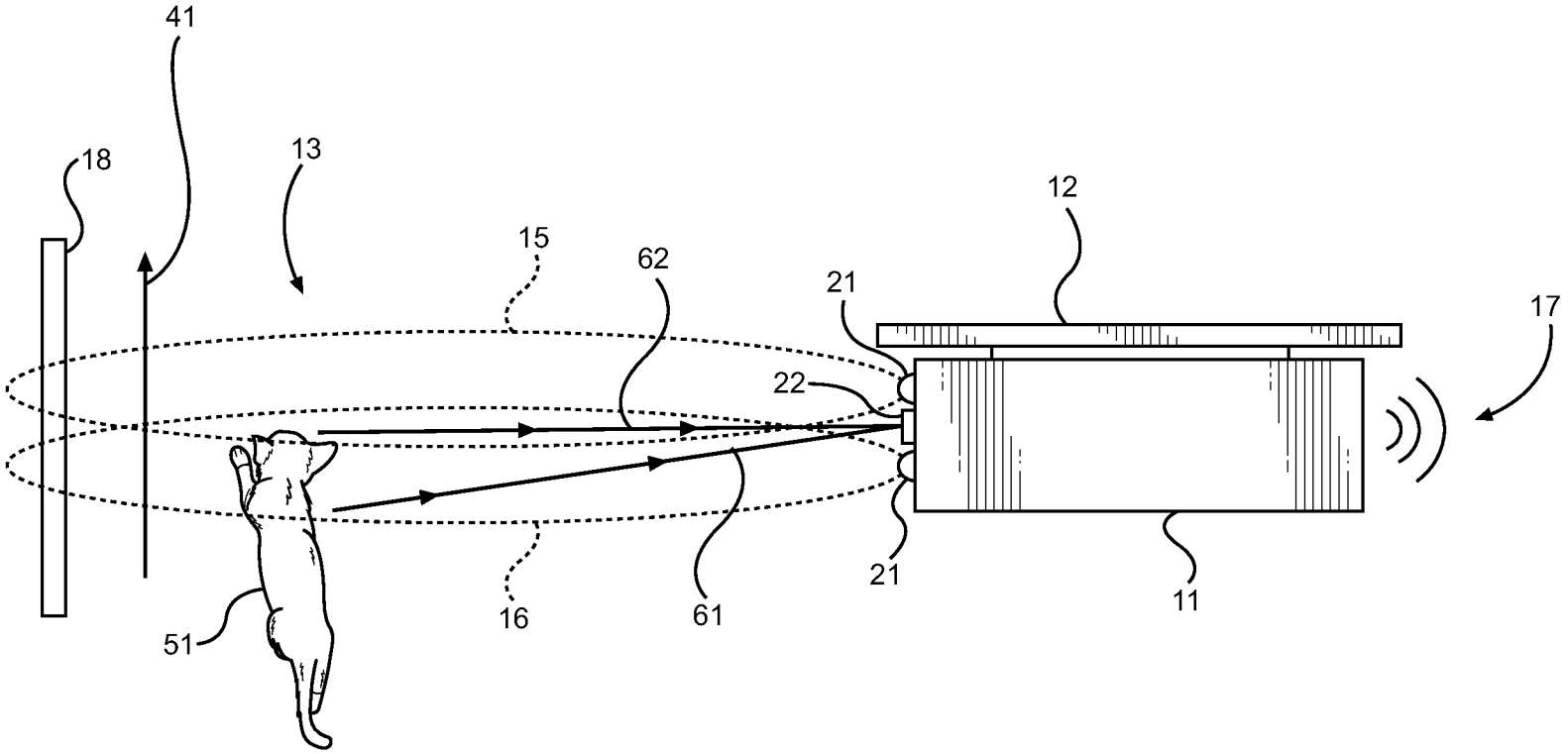
FIG. 4 shows an overhead view of the present invention in a working state, monitoring the direction of an incoming pet.

Referring now to FIG. 4, there is shown an overhead view of the receiver 11 of the present system measuring an object 51 and its direction of travel 41 within a given projection area 13. The transceiver utilizes two emitters 21 that send out a first 16 and second 15 signal either simultaneously or in quick succession. A signal receiver 22 measures the reflected signal 62 from the object 51 and the background environment 18, where the emitters 21 are pulsing at a high rate to produce a high frequency plot of detected occurrences within a short span and to accurately monitor motion through the space 13 even if the object 51 is fast-moving. The purpose of utilizing a first and second emitter 21 is to measure a differential motion by means of detecting signal strength of the reflected signal from the moving object. There are two modes of detection 1) lateral motion detection (i.e. left/right across the emitter interface), and 2) axial motion detection (i.e. changes in fore/aft distance from the emitter interface). These modes can be combined to measure complex movement or separated to monitor only a given variable, as desired by the user based on requirements of the given detection situation. Each detection method is discussed in greater detail below. Once motion of an object 51 is detected over a given threshold, an alert signal 17 is generated for either direct output or further processing by a base station. The alert signal 17 may include a physical alert, such as a noise generating alert or supersonic alert for pets, or may be a digital signal sent to a base station for processing and determination of further actions.

It is one contemplated embodiment of the present invention to produce an emitter carrier signal that is pulse or wave-modulated. The emitted signal is radiated from an emitter 21 as well as be reflected from an object moving through the projection area 13. It is desired for the emitted signal to be code modulated for reasons of measuring signal strength of the return signal and identifying the specific signal return, where time-delay is determined and used to mark the measurement of the return signal in-relation to the calculation of the signal strength. An embedded code also serves to identify one entry detection transceiver from another when multiple devices are used within close proximity with each other. Various codes can be used, but the best type of code for this purpose is known as a pseudo noise code (PN code).

Figure 5:
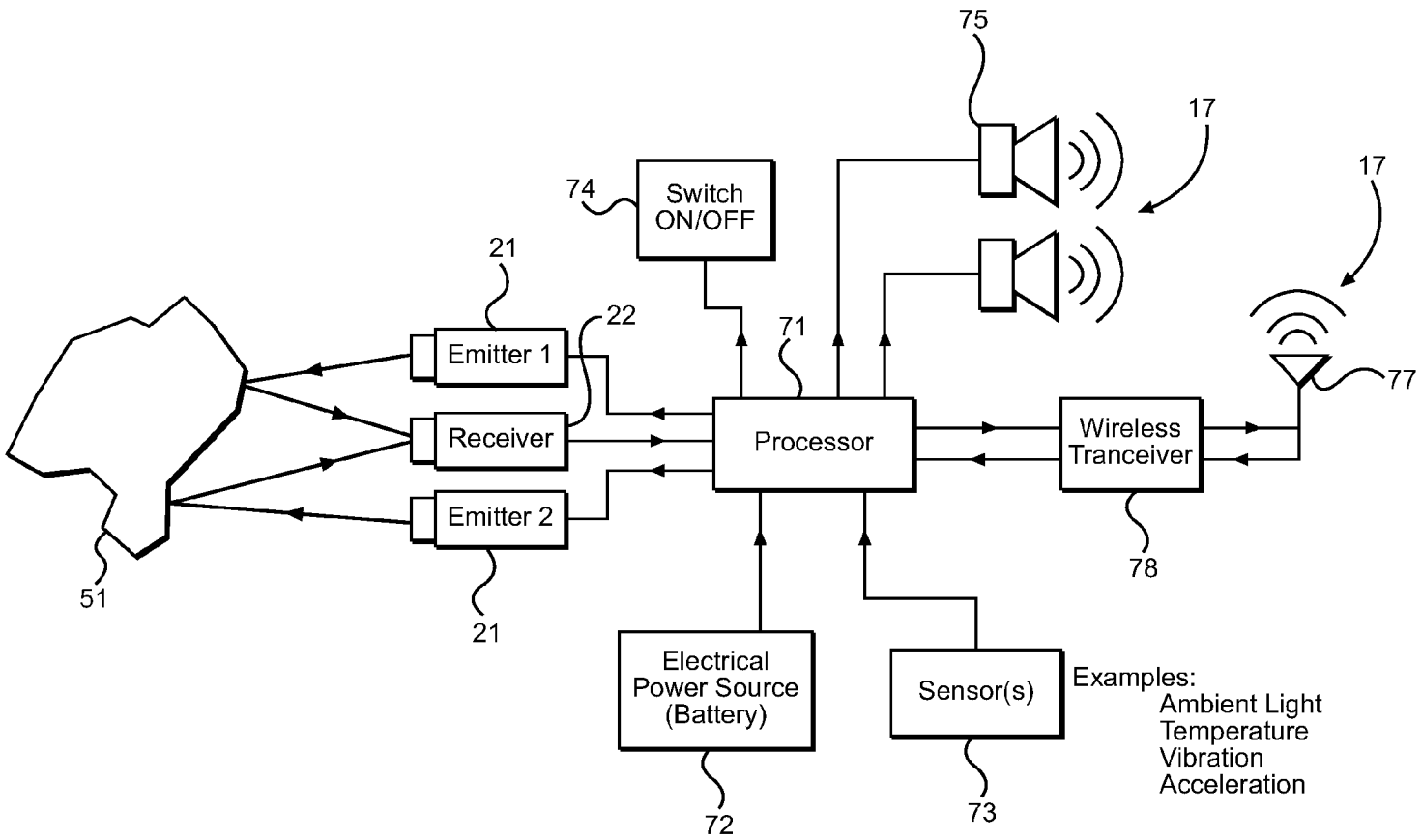
FIG. 5 shows a block diagram of the present invention transceiver.

Referring now to FIG. 5, there is shown a system view of the transceiver assembly of the present invention. The transceiver comprises a first and second emitter 21 for emitting and outgoing signal that is reflected from an object 51 within the emitter's projection area and field of view. The reflected signal is measured by a receiver 22. A computer processor 71 having a programmed logic controls the outgoing signal pulses from the emitters 21 and processes the strength and time delay as measured by the receiver 22. The processor 71 also controls the initialization phase and noise calibration of the emitters and receivers. An ambient environment sensor 73 measures the surrounding environment about the transceiver for determining periods of low activity. This sensor 73 may include an ambient light sensor, temperature sensor, vibration sensor, acceleration sensor, noise sensor, or any suitable environmental sensor that can determine when low activity around the assembly for operation of standby mode. Upon processing an object within the emitter projection area, two or more operations may ensue: a physical alert 17 may be generated in the form of an audio 75 or ultrasonic speaker 76 assembly, or a wireless transceiver 78 having an antenna 77 can broadcast a signal 17 to a base station for further processing and determination of appropriate action. Operation of the device may be controlled by a master power switch 74 on the assembly, or further the base station may control operation of the assembly and monitor battery 72 usage/power remaining in the assembly over time. Once one of the assemblies nears the end of its battery life, an alert or signal 17 can be generated to warn administrators of its impending deactivation. As an alternative, the assembly can draw A/C power if hardwiring the sensor is desired, eliminating the concern of battery usage, or using battery power when NC power ceases during outages or emergency situations. The assembly can further receive power from third party power sources such as a computer (USB, etc.) or other powered electronic hardware.

Figure 6:
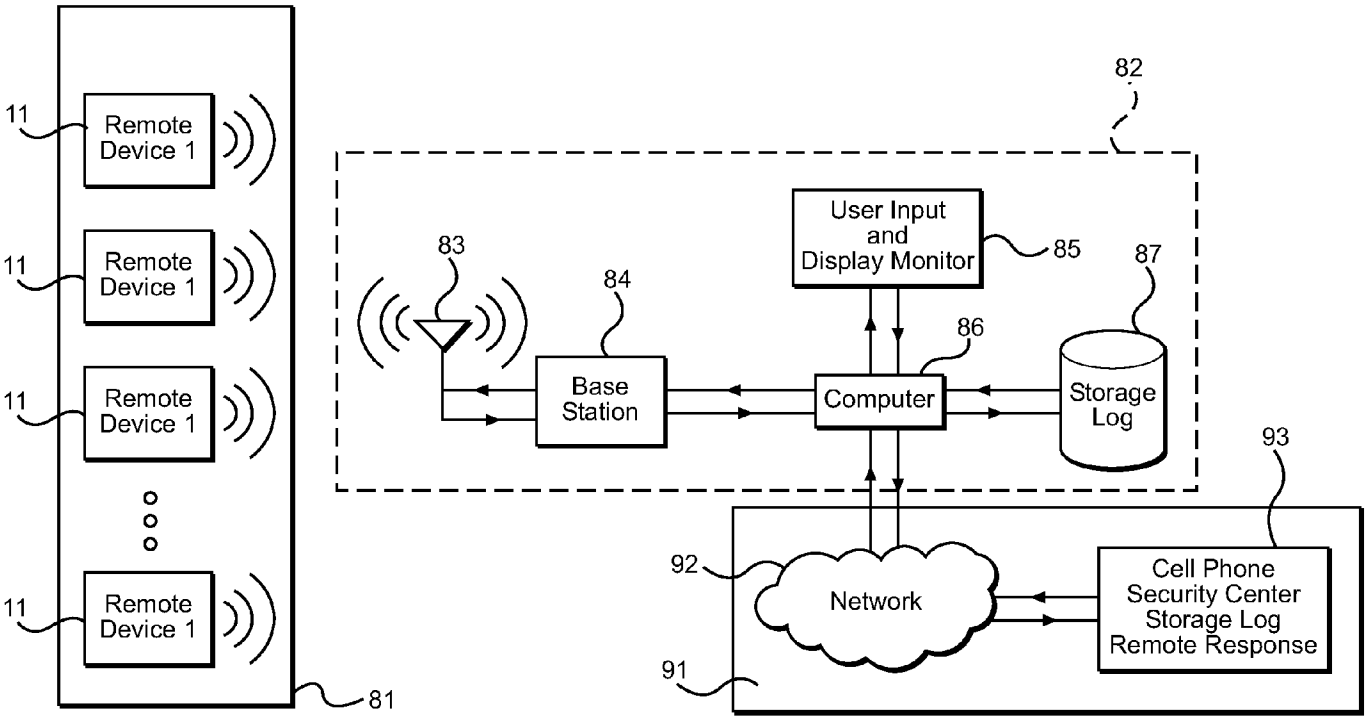
FIG. 6 shows a block diagram of the base station in operation with a plurality of transceiver units.

The present invention utilizes an embedded processor that can be programmed to issue a response to the detection event by employing multiple responses, including: 1) issuing an audible alarm within human hearing range, 2) issuing an ultrasonic alarm for pets to hear or be trained (30 KHz or ultra-sonic sound), 3) process and catalog events without issuing an alarm, and/or 4) sending a wireless signal transmission to a base station for further processing. Referring now to FIG. 6, a base station will typically be a low-cost wireless receiver 84 that transfers an alert message to a computer 86 for further alert processing, such as storage 87, activity counting, remote alert processing, sending a message through an internet network 92, or providing a visual detection reading onto a display 85 for active monitoring. The wireless receiver 84 may comprise a WAN router or Wifi router, and can also be a WAN server or Wifi server. The base station comprises a unit 82 that connects to a computing means 86, where the computing means may be a large security mainframe or computing system, or alternatively may comprise a personal computer for residential or remote use.

The base station 84 incorporates several channels to accept signals from a plurality of discrete transceiver assemblies 11 positioned throughout a location or residence, wherein each transceiver 11 location is known and can be tracked. Individual intrusions or alerts can be processed and the specific location and type of intrusion can be determined based on the given transceiver identification. Typically, wireless signals or messages are broadcasted using the ISM radio band up to a fifty meter range to be received by a base-station 84 device. Base station devices may be as simple as a dongle that plugs into a computer or laptop, and may typically use existing network media such as Bluetooth, Zigbee, or Wi-Fi (IEEE Standard 802.11b or IEEE standard 802.11g) wireless OEM devices and standards.

The monitoring computer can issue a change in the programming to each transceiver deployed and under the purview of the base station, such that the assemblies can be altered wirelessly from the base station to apply different alert processing logic depending on the given situation or the location of the assembly. As an example, if the device is protecting a living area where pets are not allowed, an entry detection transceiver can be programmed to transmit an ultrasonic alarm when the pet enters the area to correct the pet (but not the human), but thereafter not issue any alarm if the pet is moving in a direction out of a protected area and past the emitters to exit the area. Exiting the area may include lateral movement with respect to the emitter interface in a room egress direction, or movement away from the emitter interface in an axial direction. Also, the frequency of intrusions within the monitored area can be recorded remotely using wireless messages, if desired. The assemblies would have to be suitably protected from intrusion of programming using wireless encryption or other methods to prevent tampering or interference.

If the monitoring user is not present in the home or at the base station, the computer 86 can send a signal to an internet network 92 to log occurrences or further for sending messages remotely to a user or to a cloud storage network. A third party 93 can be alerted if desired, including a security monitoring service or similar alert tracking service. This remote monitoring means 91 provides greater flexibility for the system by not requiring constant vigilance and monitoring from afar.

Referring now to FIGS. 7*a* and 8*a*, the method of detecting lateral motion is shown, whereby motion of an object 51 within the emitter projection area is monitored for motion across the emitter and receiver interface 100. Upon detection of a disturbance by the ambient sensor, the assembly is activated and exits stand-by mode 113 to an elevated State 0 (or operating mode 110). When the device is in full detecting mode 110 (State 0), both emitters 21 are pulsing at a high frequency. A first set of signals comprising the first emitter S1 or second emitter S2 signal are reflected off of any foreign body 51 within the projection area and received by the receiver 22. If the signal strength or energy of the signals S1 or S2 exceeds a preset or precalibrated motion detection threshold, then an object is decidedly detected and its motion is tracked within the projection area. Hence if the reflected signal from the first emitter is greater than the second reflected emitter signal, then the device enters a first-tier State 1 (111) from State 0 (110). A second set of signals are emitted thereafter. If S2 exceeds 51 in this subsequent set of return signals, then the device enters a second-tier State 2 (112) from State 1 (111), and from this it is determined that the movement of the object is to the "RIGHT" 117 of the emitter/receiver interface. Conversely, if the device is in State 0 (110), and from the first set of emitted signals S2 is greater than S1, then the device enters a first-tier State 3 (114) from State 0 (110). A second set of emitted signals S1 and S2 are emitted, and if it is determined from the return signals of this set that S1 exceeds S2, then the device enters a second-tier State 4 (115) from State 3 (114), such that it is determined that movement of the object is to the "LEFT" 116. This is suitable for applications involving objects moving laterally to the emitter interface, such as across an entryway or across an area of observation.

Referring now to FIGS. 7*b* and 8*b*, the method of detecting axial motion toward or away from the emitter interface is shown 101. The process follows a similar pattern as the lateral motion detection logic. The ambient sensor activates the emitter assembly from Stand-by mode 123 to State 0 (or operating mode 120). The Stand-by mode is a ground state where the device is operating in low battery mode, where the presence of an object within the transceiver field of view is not anticipated. When the ambient sensor recognizes a change or when programmed, the device exits the ground state to an elevated state, where the assembly is in full detecting mode 120 (State 0). If there is a reflection from a first set of emitted signals to the signal receiver, and the strength of emitted signals S1 and S2 continues to exceed or decrease the detection threshold, then "FORWARD" or "BACKWARD" axial motion detection proceeds. Of the first set of emitted signals S1 and S2, if either S1 and S2, or S1 and S2 both exceed the given energy threshold, then the assembly enters a first-tier State 1 (121) from State 0 (120). If in a second set of emitted signals, S1 or S2 or S1 and S2 exceed the first set energy measurement, then the device enters a second-tier State 2 (122) from State 1 (121), and it is determined that the direction of motion of the object is "FORWARD" 127 to towards the emitter interface. Conversely, if the first set of emitted signals S1 and S2 are both above the set energy threshold and thereafter the strength a second set of signals S1 or S2 or S1 and S2 drop to a level below the first set reflection energy and are still greater than the threshold energy, then the device enters a second-tier State 3 (124) from State 1 (121). From this state it is determined that the movement is "BACKWARD" 126 or away from the emitter interface. An example of this detection method includes monitoring a sliding door operating without user interaction, where movement of the door is detected for alerting the user or initiating an audible alarm.

Several scenarios are contemplated for the present system, where a plurality of emitters and receivers can be utilized in conjunction with a common base station for monitoring, surveillance, object motion detection, human interaction interpretation or for security purposes. The first of these is to monitor or deter movement of pets within a household, whereby the emitters track the pet motion through an area to trigger different alerts or logging procedures. The alert may include an audible or an ultrasonic deterrent alert to ward away the pet, while the motion logging may be used to track an animal location within an area over time. Another application of the present method and system includes home surveillance and security, where unwanted entry is detected within a residence or building that can trigger alarms or log occurrences.

Along with spatial intrusion or motion detection, another conceived embodiment includes an arrangement of emitters and receivers into an aligned array to detect a passing object, such as for measuring a sports ball over a given distance, tracking its path and trajectory. For example, a golf ball detector could detect the direction of a gold ball putted past a series of emitters and receivers. This arrangement detects the motion of the ball and calculates the speed and direction thereof. The processed information is sent to a simulated golf game to represent the user's actions within a putting game with other users. The layout of the golf ball detecting embodiment could be as simple as two emitters and one receiver as shown; however depending on the accuracy required for measurement of ball speed and angle, a larger array of emitters and receivers may be deployed. Yet another embodiment in the sporting arena includes a baseball speed and motion detector array that detects the direction of a baseball thrown past a series of emitters and receivers. This arrangement detects the ball going into a predetermined "strike-zone" volume and calculates the speed and position vector of the ball as it goes past the sensor array. This information is sent to a speed and position indicator to represent the user's experience of being part of a baseball pitching game or processed as a means to determine ball location in an actual game or game simulator.

Still yet another conceived embodiment of the present invention includes interpreting hand signals, gestures or motions of a user's hand or body using a plurality of emitters and at least one receiver. This arrangement can be utilized to toggle or trigger an environmental condition such as a light switch, dimmer switch or other controls using a hands-free interface. The motion of the user triggers an environmental condition within the area. The system ambient sensor first detects a disturbance to wake the emitters, which then emit signals received by the receiver for interpretation of movement. Any combination, array or alignment of emitters and receivers is contemplated for the present invention, where an ambient trigger initiates awakening of the system, and the presence and motion of an object is tracked, where local commands can be initiated or signals can be sent to a base station for processing or action determination.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of detecting motion using a transceiver and a base station, comprising the steps of:

entering a ground state of beginning motion detection, wherein a first and second signal emitters are activated;

transmitting a first transmission signal from said first emitter and a second first transmission signal from said second emitter;

receiving a initial first set of return signals, comprising a first and second return signal with a receiver, wherein said signals are reflected from an object in front of at least one of said first or second emitter;

calculating a difference between a signal strength of said first set of return signals and second return signals against a signal strength of a first and second predetermined threshold signal;

determining whether a foreign object is present based on said difference calculation;

entering another an operational state based on said determination of the presence of said foreign object;

if said signal strength of said first set of return signals exceeds said signal strength of said first and second predetermined threshold signal, calculating a difference between a signal strength of said first return signal of said first set of return signals and a signal strength of said second return signal of said first set of return signals;

transmitting a second transmission signal from said first emitter and a second transmission signal from said second emitter;

receiving a second set of return signals, comprising a first and second return signal with a receiver, wherein said signals are reflected from an object in front of at least one of said first or second emitter;

calculating a difference between a signal strength of a first return signal of said second set of return signals and a signal strength of a second return signal of said second set of return signals;

determining a movement of said foreign object based on comparing said signal strengths of said first set of return signals and said signal strengths of said second set of return signals.

2. The method of claim 1, wherein said entered operational state is a standby state, if said first and second predetermined threshold signal signals exceed said first and second return signal strengths of said first set of return signals.

3. The method of claim 1, further comprising the steps of:

detecting a change in environmental conditions via an ambient sensor;

instructing a transmitter to enter said ground state.

4. The method of claim 1, further comprising the steps of:

calibrating said emitters in a specific environment;

obtaining a first and second threshold signal based on said calibration.

5. The method of claim 1, further comprising:

said entered operational state is one of a plurality of first-tier elevated operational states;

continuing to transmit said first and second transmission signals;

receiving an intermediate set of said first and second return signals;

calculating a difference between said first and second return signals of said intermediate return signal set against first and second predetermined threshold signals;

determining whether a foreign object is still present based on said difference calculation;

comparing differences between said intermediate set of return signals and said threshold signals with differences between said initial set of return signals with said threshold signals;

determining initial length of displacement of a foreign object based on said comparing of initial and intermediate return signal set differences;

entering a further second operational state based on said determination of the displacement of a foreign object.

6. The method of claim 5, wherein said plurality of first-tier elevated operational state states entered is dependent on which of said first or second return signals within said initial return signal set is least like said threshold signals.

7. The method of claim 5, wherein said entered further second operational state is said ground state and repeats the steps of claim 1.

8. The method of claim 5, further comprising:

said entered further second operational state is one of a plurality of second-tier elevated operational states;

continuing to transmit said first and second transmission signals;

receiving a final set of said first and second return signals;

calculating a difference between said first and second return signals against a first and second predetermined threshold signals;

determining whether a foreign object is still present based on said difference calculation;

comparing said differences between said final set of return signals and said threshold signals with differences between said intermediate set of return signals with said threshold signals;

determining final length of displacement of a foreign object based on said comparing of final and intermediate return signal set differences;

comparing said initial length of displacement with said final length of displacement to determine said foreign object's direction of motion.

9. The method of claim 8, wherein if no foreign object is detected a ground state is entered and the steps of claim 1 are repeated.

10. The method of claim 8, wherein in no final displacement is found a first-tier elevated level operational state is entered and the steps of claim 8 are repeated.

11. The method of claim 8, further comprising the step of:

initiating an alarm after a direction of motion is determined.

12. The method of claim 8, further comprising the steps:

transmitting a wireless notification to a remote computer after a direction of motion is determined.

13. The method of claim 8, further comprising the step of:

transmitting a notification to cell phone after a direction of motion is determined.

14. The method of claim 8, further comprising the step of:

automatically modifying an environmental condition after a direction of motion is determined.

15. A motion detection system comprising:

at least one transceiver comprising;

a. a microprocessor configured to calculate a difference between a signal strength of a first set of return signals and a signal strength of a first and second predetermined threshold signal;

if said signal strength of said first set of return signals exceeds said signal strength of said first and second predetermined threshold signal, calculating a difference between a signal strength of said first return signal of said first set of return signals and a signal strength of said second return signal of said first set of return signals;

transmitting a second transmission signal from a first emitter and a second transmission signal from a second emitter;

receiving a second set of return signals, comprising a first and second return signal with a receiver, wherein said signals are reflected from an object in front of at least one of said first or second emitters;

calculating a difference between a signal strength of a first return signal of said second set of return signals and a signal strength of a second return signal of said second set of return signals;

determining a movement of said object based on comparing said signal strengths of said first set of return signals and said signal strengths of said second set of return signals;

b. a memory;

c. at least two signal emitters;

d. at least one signal receiver.

e. network connection means;

f. a power source;

g. an ambient environment sensor;

a base station in wireless communication with said transceiver and comprising;

a. a microprocessor;

b. a memory;

c. a network connection means;

d. a power source;

a network;

a remote alert receiving device.

16. The system of claim 15, wherein said alert receiving device is a cell phone.

17. The system of claim 15, wherein said alert receiving device is a personal computing device.

18. The system of claim 15, wherein said signal emitters emit signals and said receiver receives said signals after they are reflected off objects in the local environment.

19. The system of claim 15, wherein received signals are transmitted to said base station.

20. The device of claim 15, wherein said base station processes received signals via said base station microprocessor to detect motion in the local environment.

21. The system of claim 15, wherein each of said transceivers is in communication with an environmental condition trigger.

22. The system of claim 15, further comprising a plurality of aligned transceivers to detect motion over a distance.

* * * * *